United States Patent [19]

Frost

[11] 3,993,336

[45] Nov. 23, 1976

[54] GUARD TO PREVENT OPENING OF SLIDING DOORS

[76] Inventor: Genevieve O. Frost, 4807 5th Ave., Kenosha, Wis. 53140

[22] Filed: Aug. 25, 1975

[21] Appl. No.: 607,342

[52] U.S. Cl. ..... 292/263; 292/288; 292/DIG. 46

[51] Int. Cl.[2] ..... E05C 17/34

[58] Field of Search ..... 292/DIG. 46, 338, 339, 292/262, 263, 288

[56] References Cited

UNITED STATES PATENTS

| | | | |
|---|---|---|---|
| 3,181,905 | 5/1965 | Bisbing | 292/DIG. 38 |
| 3,486,781 | 12/1969 | Crum | 292/262 |
| 3,554,592 | 1/1971 | Katz | 292/263 |

*Primary Examiner*—Richard E. Moore
*Attorney, Agent, or Firm*—Axel H. Johnson

[57] ABSTRACT

A guard to prevent unauthorized opening of sliding doors and similar closures, comprising a longitudinal member having a major portion and a minor portion hinged together end-to-end. The guard when fully extended, is positioned normal to the direction of opening of the door, and extends between the jamb and the edge of the door and preferably resting on the floor. When the door is to be partially opened for ventilation, the minor portion is hinged 180° so as to overlap the major portion. The resultant shortened guard then permits the door to be opened only an amount equal to the length of the minor portion.

3 Claims, 9 Drawing Figures

GUARD TO PREVENT OPENING OF SLIDING DOORS

BACKGROUND OF THE INVENTION.

1. Field of the Invention.

This invention concerns a guard to prevent unauthorized opening of sliding doors or similar closures.

2. Description of the Prior Art.

The prior art embraces similar devices having elements that slide relative to each other. None of the known art concerns a guard that has a hinged portion that permits shortening to maintain the security, while permitting to door or closure to be partially open for ventilation.

SUMMARY OF THE INVENTION

This invention provides an effective guard to prevent unauthorized opening of sliding doors or closures. It comprises a longitudinal pair of tubular portions, namely a major portion and a minor portion. The portions are hinged together end-to-end to permit shortening of the guard.

When in use the guard is positioned in contact at one end thereof with the edge of the door and normal to the direction of opening. The other end of the guard abuts the jamb of the door frame. If it is desired to open the door partially for ventilation and still retain the function of the guard against unauthorized opening, the minor portion is hinged over the major portion, thereby shortening the guard. The door can then be opened an amount equal to the length of the minor portion.

Referring to the drawings.

Figure 2:
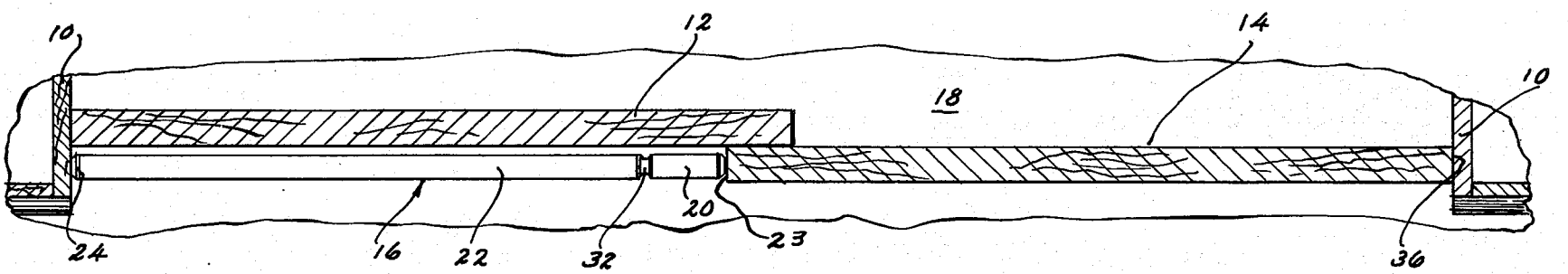
FIG. 2 is a section taken at 2—2 of FIG. 1.
Figure 1:
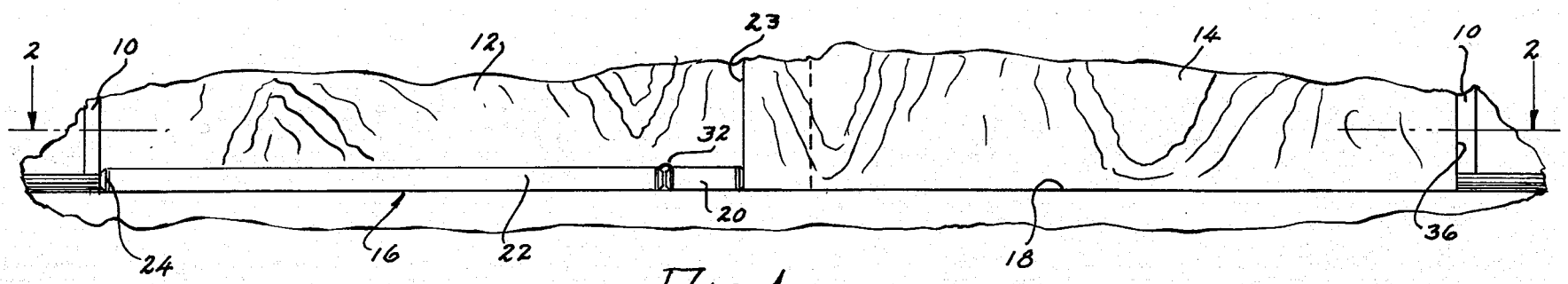
FIG. 1 is a fragmentary upright view showing the guard in place on the floor so as to maintain the door in a completely closed position.
Figure 3:
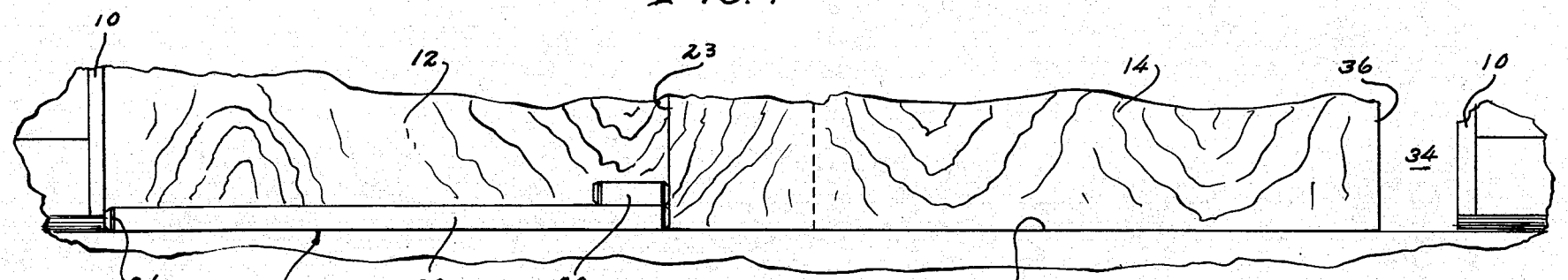
FIG. 3 is a view similar to FIG. 1, but showing the guard shortened to permit the door to partially open for ventilation.

Referring again to the drawings:

In FIGS. 1 to 3, the door jambs 10 comprise a conventional door frame which provides the vertical abutments for the doors 12 and 14. The customary position of the guard 16 is that shown as it rests upon the floor 18, in this instance. Guard 16 is fully extended in FIGS. 1 and 2 and maintains door 14 in the closed position, with the minor portion 20 of the guard end-to-end with the major portion 22, and abutting door edge 23.

The guard 16 is tubular and preferably of plastic, of a rectangular cross-section and of a suitable length. End caps 24 and 26 are of plastic and conform to the bore of the members 20 and 22, and have shank portions 25 which are slightly tapered to permit pressing them into the bore of both portions 20 and 22. Hinge caps 28 and 30 are similar to caps 24 and 26 with one exception; a flexible hinge web 32 is molded integrally as part of both caps 28 and 30 to form an integral unit.

Figure 4:
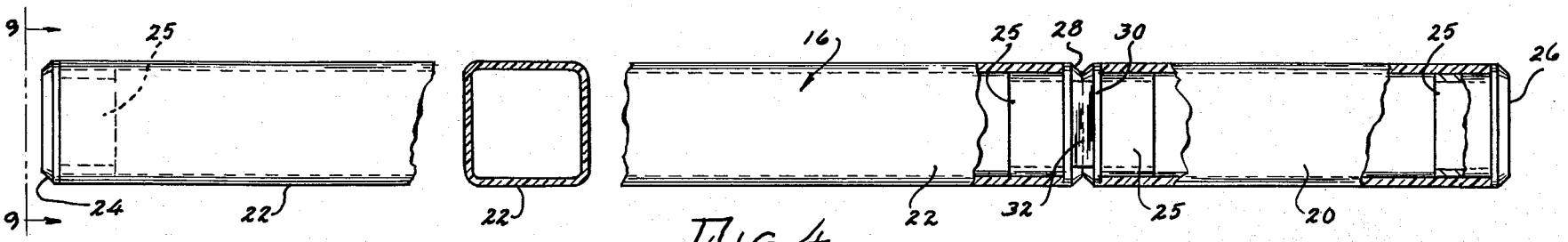
FIG. 4 is an enlargement of the guard with parts in section.
Figure 5:
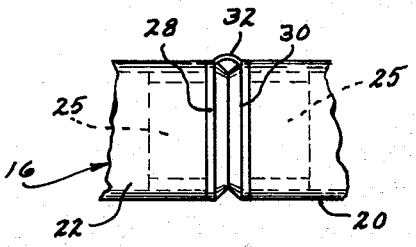
FIG. 5 is a projection of a portion of FIG. 4 showing the hinge.
Figure 9:
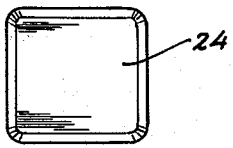
FIG. 9 is a view taken at 9—9 of FIG. 4.
Figure 8:
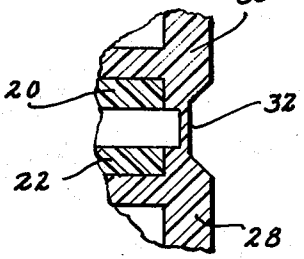
FIG. 8 is an enlargement of a section taken at 8—8 of FIG. 7.
Figure 7:
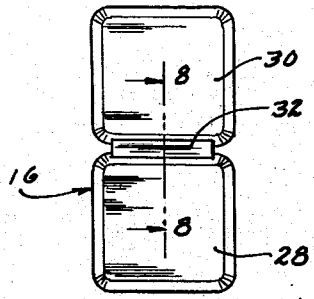
FIG. 7 is an end view of FIG. 6.
Figure 6:
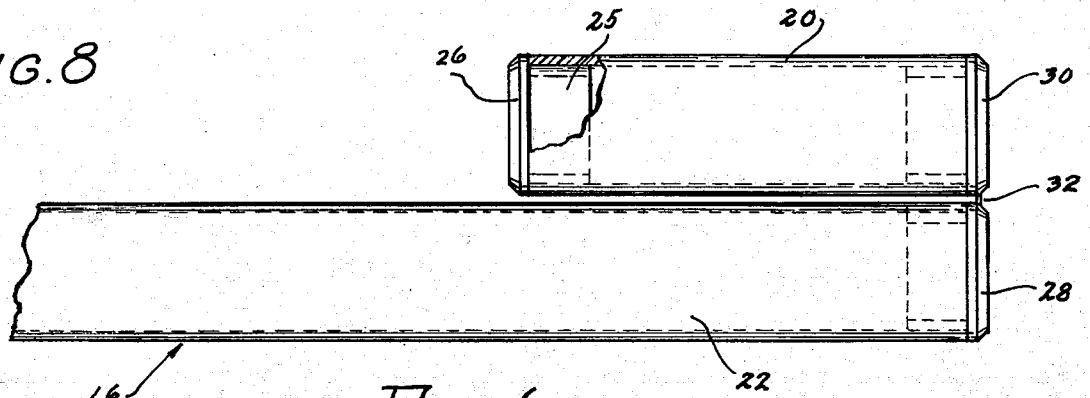
FIG. 6 is a fragmentary view of a portion of the guard with the minor portion hinged 180° over the major portion, as also shown in FIG. 3.

When it is desired to permit the door 14 to be slightly open for ventilation, and yet prevent unauthorized further opening as at 34 of FIG. 3, the minor portion 20 is hinged to a position 180 degrees from that shown in FIGS. 1, 2 and 4. Door 14 can then be opened only an amount equal to the length of the minor portion 20 and defined by jamb 10 and edge 36 of door 14. If the length of the guard 16 is longer than suitable for the situation, the cap 24 is removed from the portion 22 and the latter cut to the desired length and the cap replaced.

It is within the purview of this invention to employ a cross-section for the members 20 and 22 other than that shown. Other types of hinges can also be provided as substitutes for those indicated as 32, if desired.

The above being a complete description of a illustrative embodiment of the invention, what is claimed as new and desired to be secured by Letters Patent of the United States is:

1. A guard to prevent the opening of a sliding door, and to optionally permit partial opening of said door, said guard comprising a longitudinal major portion, and a longitudinal minor portion, said portions positioned in an end-to-end abutting relationship, said portions terminating in cap members at the abutting ends thereof, a hinge integrally connecting the mutually-opposed cap members to permit pivoting of said minor portion 180° relative to said major portion, and parallel to said major portion.

2. A guard as set forth in claim 1, in which said major and minor portions and said caps are of non-metallic materal.

3. A guard as set forth in claim 1, in which said hinge and said mutually-opposed caps comprise a unitary molding of non-metallic material.

* * * * *